US005344006A

United States Patent [19]

Mazzeo

[11] Patent Number: 5,344,006

[45] Date of Patent: Sep. 6, 1994

[54] NECK CLIP BOTTLE CARRIER WITH EASY ACCESS FEATURE

[75] Inventor: Christine Mazzeo, Roswell, Ga.

[73] Assignee: Riverwood International Corporation, Atlanta, Ga.

[21] Appl. No.: 123,492

[22] Filed: Sep. 17, 1993

[51] Int. Cl.[5] ..... B65D 75/00

[52] U.S. Cl. ..... 206/153; 206/147; 206/158; 294/87.2

[58] Field of Search ..... 206/145, 147, 151, 152, 206/153, 158, 161, 162, 194; 294/87.2

[56] References Cited

U.S. PATENT DOCUMENTS

| | | | |
|---|---|---|---|
| 3,815,947 | 6/1974 | Olsen | 206/158 |
| 3,860,281 | 1/1975 | Wood | 294/87.2 |
| 4,180,191 | 12/1979 | Wood | 206/147 |
| 4,305,500 | 12/1981 | Jaeschke | 206/147 |
| 4,318,476 | 3/1982 | Wood et al. | 294/87.2 |
| 4,372,599 | 2/1983 | Kiedaisch et al. | 206/158 |
| 4,403,689 | 9/1983 | Wood | 206/158 |
| 5,273,156 | 12/1993 | Harris | 206/147 |

FOREIGN PATENT DOCUMENTS

| | | | |
|---|---|---|---|
| 2077689 | 12/1981 | United Kingdom | 206/145 |

*Primary Examiner*—David T. Fidei

[57] ABSTRACT

A neck clip bottle carrier having angled side panels of two-ply construction. The lower edges of openings in the side panels engage the underside of bottle flanges to support the bottles. The outer ply of one of the side panels is divided into flaps which overlie tear-away sections in the underlying inner ply. The flaps are adhered to lower portions of the tear-away sections. When the tear-away sections are separated, the overlying flaps pivot upwardly to a point permitting removal of the associated bottle. The tear-away sections are designed so as not to cause failure of the carrier under high loadings.

15 Claims, 3 Drawing Sheets

NECK CLIP BOTTLE CARRIER WITH EASY ACCESS FEATURE

FIELD OF THE INVENTION

This invention relates to bottle carriers of the neck clip type, wherein the bottles are supported at their necks by an elongated tube-like carrier. More particularly, it relates to a neck clip carrier with improved means for removing a bottle.

BACKGROUND OF THE INVENTION

Beverage bottles are often packaged in neck clip carriers, particularly large plastic bottles which have a flange or collar on the neck just below the bottle cap. Openings in the bottom of the carrier receive the upper portions of the bottles, while the lower edges of bottle neck openings in the sloped side panels engage the underside of the bottle flanges to support the bottles during lifting and carrying. While neck clip carriers provide an economical means for packaging and carrying bottles, it can at times be difficult to remove a bottle from the package. Because the carriers are clipped tightly on the bottles, their side panels cannot readily be pulled apart to move the flange support edges away from the flanges, making it necessary to tear the side panels beneath the flange support edges. The thick paperboard or the two-ply design often used to impart strength to the carriers can be quite difficult to tear.

To overcome this problem carriers have been designed with tear-away sections immediately beneath the flange support edges. One approach, disclosed in U.S. Pat. No. 4,180,191, employs a two-ply design, with aligned tear-away sections in the layers forming one of the side panels. Although this provides access to the bottles, the structural integrity of the carrier is at risk if one or both of the overlying tear-away sections were to prematurely fail due to lifting and carrying stresses. Another approach, disclosed in U.S. Pat. No. 4,318,476, also employs a two-ply design, with the outer ply incorporating a tear-away section and the underlying layer including an easily severed cut line. This arrangement also is subject to carrier failure since both of the paperboard layers beneath the flange support edges are weakened in the flange area.

It is an object of the invention to provide a neck clip carrier which allows easy access to the bottles without compromising the structural integrity of the carrier. Another object is to provide a neck clip carrier of this type which permits use of a handle panel for ease of carrying.

BRIEF SUMMARY OF THE INVENTION

The invention is used in connection with a neck clip bottle carrier of the type having a bottom panel containing openings for receiving the upper portions of bottles and angled side panels foldably connected to the bottom panel. The upper portions of the side panels contain openings for receiving the necks of bottles, with the lower edges of the openings engaging the underside of bottle neck flanges to support the bottles in the carrier. The side panels are of two-ply construction, with the inner ply of one of the side panels including a tear-away section beneath each bottle neck opening and the overlying outer ply being divided into spaced flaps so that each flap overlies one of the tear-away sections. When the tear-away sections are separated from their side panel ply, the overlying flaps move with them, pivoting up to a point which permits removal of the associated bottle.

In a preferred arrangement, each tear-away section includes a tab extending beyond its overlying flap to a point below the bottom panel, and each flap is adhered to a lower portion of an underlying tear-away section. Preferably, at least the end flaps of the carrier include a lower portion the side edges of which substantially coincide with lower boundary portions of the tear-away sections. Such an arrangement permits the flaps to be adhered to the underlying ply without interfering with the separation of the tear-away section or the upward pivoting of the flaps.

In addition, the preferred arrangement provides for the weakened side edges of the tear-away sections to terminate at a point outwardly spaced from the lower support edges of the bottle neck openings. This preserves the structural integrity of the carrier, preventing failure of the tear-away sections during use.

The invention is particularly well suited for use in connection with a three-bottle carrier since the two-ply construction contributes to the strength needed to support such heavy loads while at the same time permitting ready access to a bottle. The design also provides for a handle panel extending above the top of the carrier. Moreover, the carrier can be formed from a blank of minimal size by standard erection procedures.

The above and other aspects and benefits of the invention will readily be apparent from the more detailed description of the preferred embodiment of the invention which follows.

DETAILED DESCRIPTION OF THE PREFERRED EMBODIMENT

Figure 1:
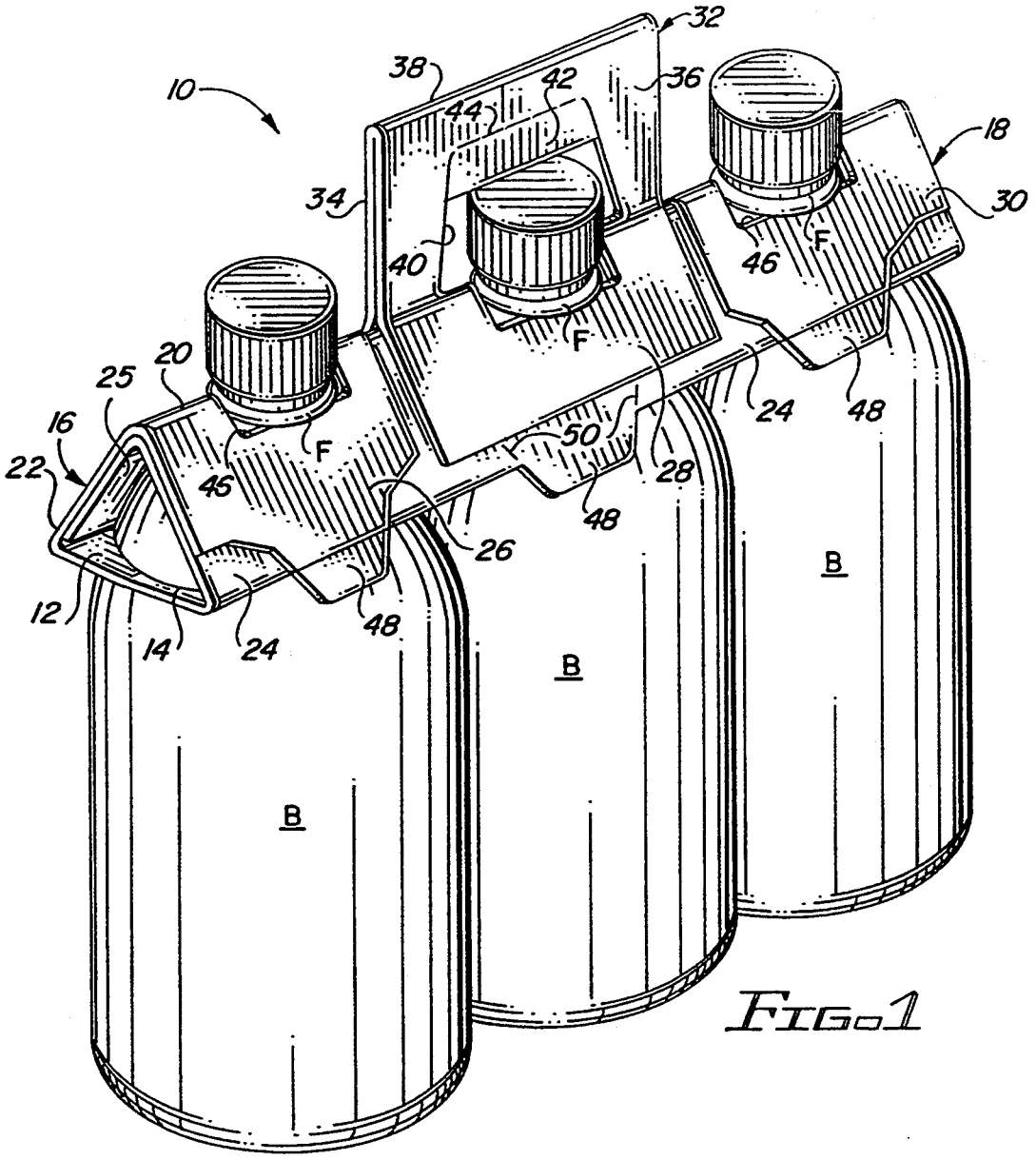
FIG. 1 is a pictorial view of the neck clip carrier of the invention, illustrated as a three-bottle carrier.

Referring to FIG. 1, the illustrated neck clip carrier 10 is designed to hold three bottles B. It includes a bottom panel 12, which contains cutouts 14 for receiving the bottles, and side panels 16 and 18, which are angled toward each other from the side edges of the bottom panel, meeting at the upper central fold line 20. The side panels are of double layer construction, with the outer ply 22 of side panel 16 being foldably connected to one side edge of bottom panel 12 and the inner ply 24 of side panel 18 being foldably connected to the other side edge. The inner ply 24 of side panel 18 is connected by a fold line lying directly beneath the fold line 20 to the inner ply 25 of side panel 16, while the outer ply of side panel 18 is connected to the outer ply 22 of side panel 16 by the fold line 20. Although the outer ply 22 of side panel 16 is continuous, its extension into the side panel 18 is interrupted by cutouts to form three separate spaced flaps 26, 28 and 30. A handle panel 32 is formed from panel sections 34 and 36, which lie between the outer ply 22 and the central flap 28, and are connected along handle fold line 38. A handle cutout 40 in each ply of the handle panel allows the handle to be gripped, and handle panel tabs or flaps 42 are adapted to be folded under by a user along the fold lines 44.

Each side panel includes a bottle neck cutout 46 that interrupts the central fold line 20 opposite the location of a bottle, and each cutout has a lower edge that engages the underside of the flange F of a bottle when the carrier is lifted to support the bottles. Each lower edge of the cutouts is comprised of the adjacent edges of the cutouts in adjacent inner and outer plies of the side panels, which in the case of the side panel 18 comprises the cutout edges of the inner ply 24 and the outer ply flaps 26, 28 and 30. The inner ply 24 additionally includes three tabs 48 which extend down beyond the bottom panel 12. Each tab represents an extension of a tear-away section hidden by the end flaps 26 and 30. The tear-away section beneath the central flap 28 is only partially covered, so that the lower extremity of the cuts or slits 50 of the central tear-away section can be seen in FIG. 1.

Figure 2:
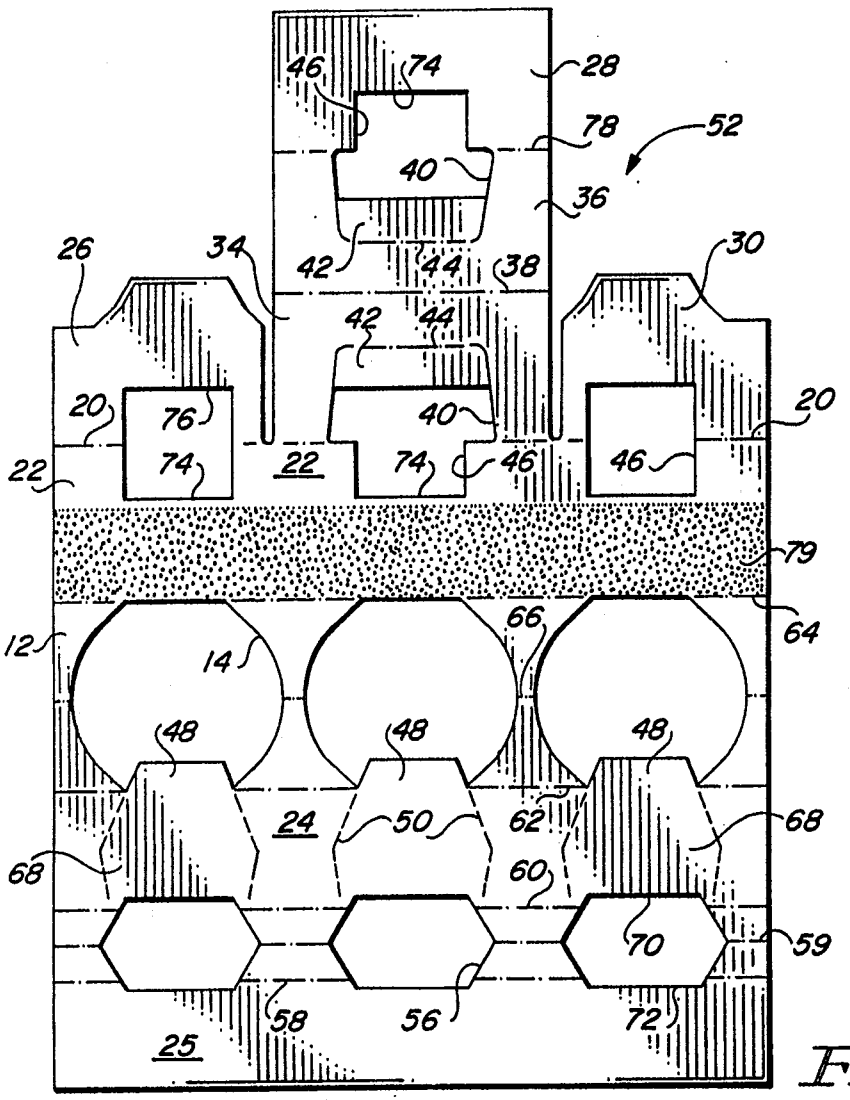
FIG. 2 is a plan view of a blank used to form the carrier.

Referring now to FIG. 2, wherein like reference numerals to those used in FIG. 1 refer to similar elements, a blank 52 used to form the neck clip carrier of FIG. 1 is comprised of a sheet of flexible, foldable material such as conventional paperboard used in the carrier industry. At the lower end of the blank, as viewed in the drawing, is inner ply section 25 which is connected to the other inner ply section 24 along fold line 54. The fold line 54 is interrupted by three cutouts 56, half of each cutout extending into the inner ply section 24 and half into the inner ply section 25. Score lines 58 and 60 extend between the outer edges of the cutouts to facilitate the flexing that occurs when a collapsed carrier is installed on bottles to be packaged. The inner ply panel section 24 is connected at its other end along fold line 62 to the bottom panel section 12, which in turn is connected along fold line 64 to outer ply panel section 22. The bottom panel section 12 contains a median fold line 66 which is interrupted by the three spaced bottle cutouts 14. The fold line 64 is interrupted by the ends of the bottle cutouts, while the fold line 62 is interrupted by the tabs 48 which extend into the cutout area from the inner ply section 24.

As indicated above, the inner ply section 24 includes cuts 50 which form the outline of tear-away sections 68. The cuts extend generally from the intersection of the tabs 48 and the cutouts 14 to a point adjacent but outside of the edge 70 of the cutouts 56. The edges 70 and the opposite edges 72 of the cutouts 56 are the inner ply flange support edges in the side panels of the carrier.

The outer ply section 22 is connected to the outer ply end flaps 26 and 30, and to the handle ply 34 as well, along fold line 20. Interrupting the fold line 20 are the cutouts 46, which extend from the outer ply section 22 into the end flaps 26 and 30 and into the handle ply 34. Similar to the support edges of the cutouts 56, the opposite edges 74 and 76 of the cutouts 46 and the edge of the center cutout lying in the outer ply section 22 are the outer ply flange support edges in the side panels of the carrier. The portion of the center cutout 46 which extends into the handle ply 34 is one of the handle openings or cutouts 40. The other handle cutout 40 is in the handle ply section 36, which is connected to the handle ply section 34 along the fold line 38. The handle cutout in the handle ply section 34 extends into the bottle neck cutout 46 in the central flap 28, and the outer edge 74 of that cutout is also a flange support edge. As illustrated, the fold lines connecting one section of the blank to the next are parallel to each other and to the end edge of the blank. A fold line 78 parallel to the fold line 20 connects the central flap 28 to the handle ply section 36.

Assuming that the inner face of the blank of FIG. 2 is facing the viewer, the first step in forming a carrier from the blank is to fold the inner ply section 25 about the fold line 54, bringing the section 25 into contact with the section 24, then fold the lower portion of the blank about the fold line 66 in the bottom panel section 12. The stripe of glue 79 on the outer ply section 22 bonds the folded inner ply section 25 to the section 22 to form the interim configuration shown in FIG. 3. Although the glue stripe is illustrated in the position described, it will be understood that the same result can be achieved by providing an adhesive stripe on the opposite face of the inner ply section 25.

Figure 4:
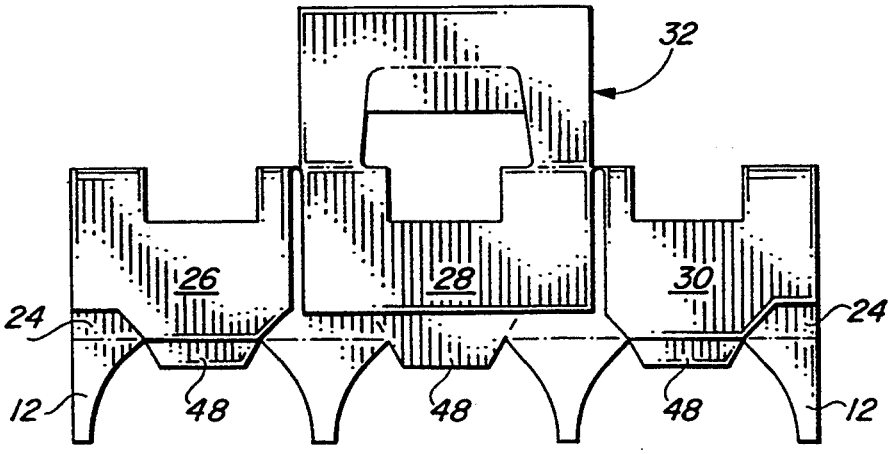
FIG. 4 is a plan view of the blank in its final collapsed condition.
Figure 3:
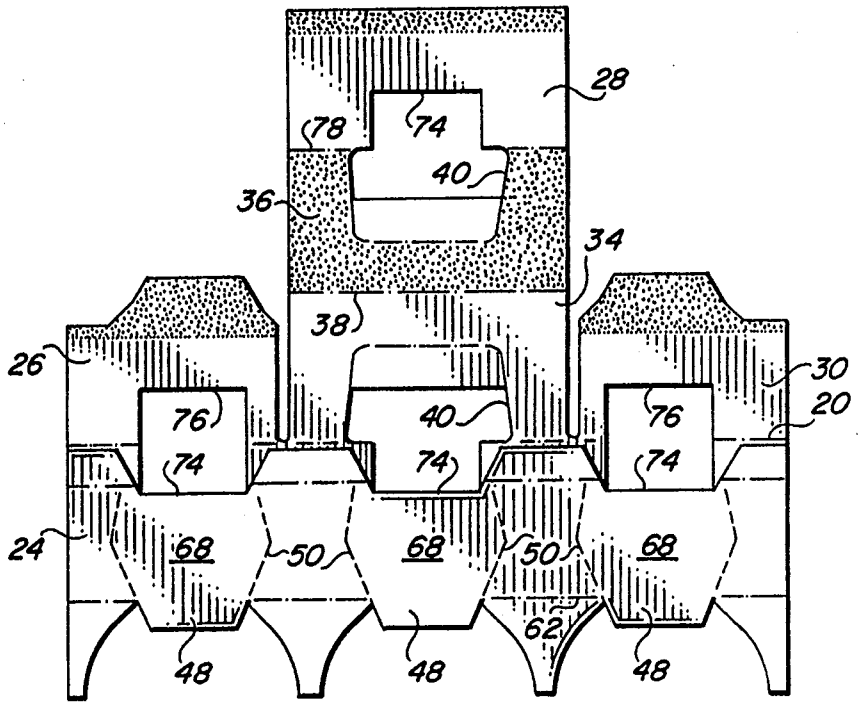
FIG. 3 is a plan view of the blank of FIG. 2 after it has been folded to an intermediate stage during formation of a carrier.

The final step in forming the carrier is to apply adhesive to the stippled areas of FIG. 3, then fold the handle flap 36 about the fold line 38 and the end flaps 26 and 30 about the fold line 20. This adheres the handle plies 34 and 36 together and also adheres the center flap 28 and the end flaps 26 and 30 to the inner side panel ply 24 to form the collapsed carrier shown in FIG. 4.

The collapsed carrier is applied to bottles arranged so as to be aligned with the openings in the bottom panel by moving the collapsed carrier down over the bottles. The fold lines 66 in the bottom panel 12 and the fold lines 58 and 60 in the inner side panel sections 26 and 24 allow the side panels to flex away from each other as they are forced out by the relative movement between the carrier and the bottles. Relative movement is continued until the flanges F on the bottles pass the lower locking or support edges of the side panel cutouts, thereby allowing the side panels to snap into position beneath the flanges to form the finished package of FIG. 1.

Figure 5:
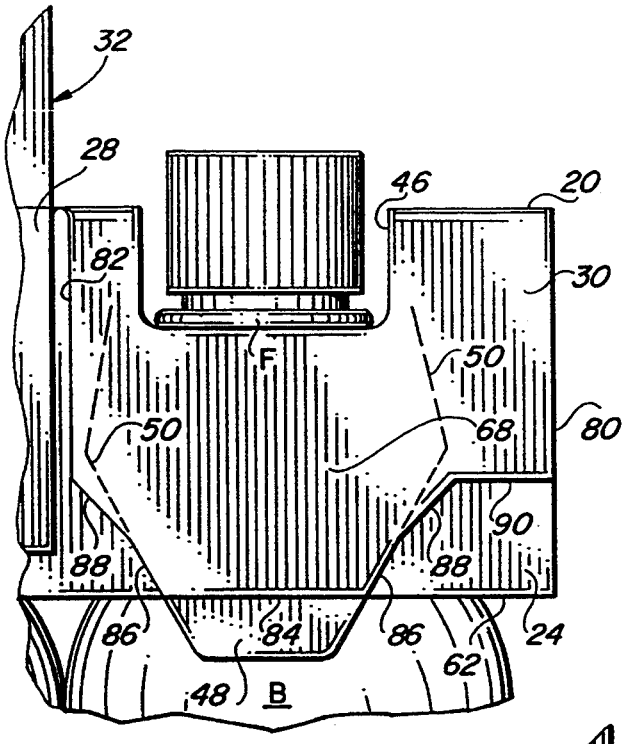
FIG. 5 is an enlarged partial side view of the carrier, illustrating the end portion of the carrier of FIG. 1.

Turning now to FIG. 5, it can be seen that the side panel flap 30 includes an outer end edge 80, an inner end edge 82 spaced from the central flap 28 and a lower edge 84 which is substantially aligned with the lower fold line 62 of the bottom panel 12. The length of the edge 84 is substantially equal to the width of the base of the tab 48. Tapered edge portions 86, which substantially overlie the lower end portion of the angled cut lines 50, extend up from the lower edge 84 and are connected to more outwardly tapered edge portions 88. The inner tapered portion 88 at the left of the drawing connects directly to the inner end edge 82, while the outer tapered portion 88 is connected to a horizontal edge 90, which extends over to the outer end edge 80.

Figure 6:
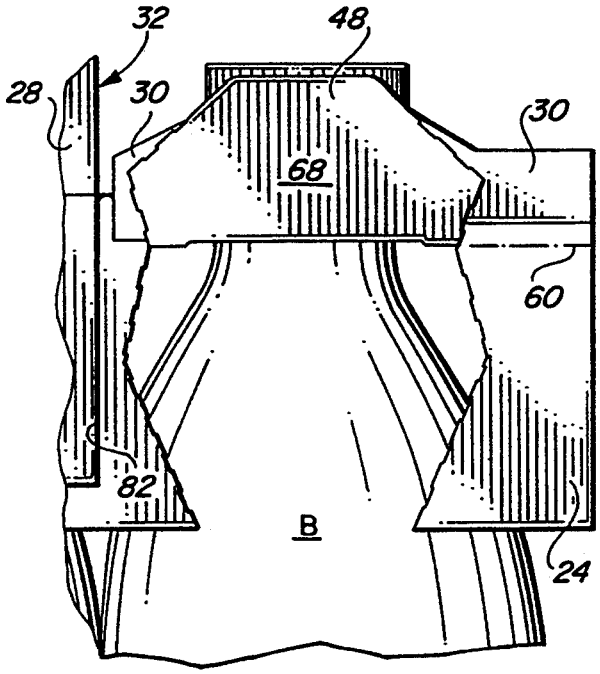
FIG. 6 is an enlarged partial side view of the carrier similar to the view of FIG. 5, but showing the end portion with the tear-away section separated and folded up.
Figure 7:
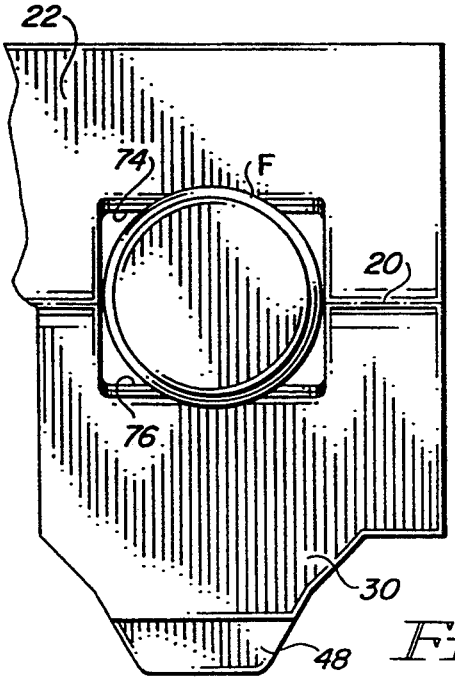
FIG. 7 is an enlarged partial plan view of the carrier with the separated tear-away section in the position shown in FIG. 6.

To remove the end bottle from the carrier, the tab 48 of the side panel 24 is grasped and pulled up, causing the tear-away section 68 to be torn away from the side panel 24 along the cut lines 50 and pivoted up about the score line 60. The overlying flap 30 moves with the tear-away section 68 as a unit to approximately the position shown in FIG. 6. Because the flap 30 pivots during this movement about the fold line 20, which is spaced from the score line 60, the pivoting movement of the tear-away section 68 is not capable of pivoting the flap 30 much beyond this point. This is entirely adequate, however, to facilitate removal of the end bottle. As shown in FIG. 7, when the tear-away section 68 and end flap 30 reach this point, it is a simple matter to merely pull horizontally on the tab to cause the support edges 70 and 76 to move out from beneath the bottle flange F, enabling the bottle to be removed.

It will be appreciated that several factors contribute to the success of this carrier design. By separating the side panel ply overlying the panel 24 into spaced flaps, a pulling force exerted on a tear-away section tab results in the overlying flap pivoting up out of place as described above. If the outer side panel layer were a single integral layer, the pulling force would not be enough to move the entire overlying outer ply.

As best seen in FIG. 5, the lower portion of the flap 30 substantially directly conforms to the shape of the underlying tear-away section 68. Thus when the end flap 30 is folded into place overlying the inner side panel ply 24, the glue on the underside of the lower portion of the end flap contacts only the tear-away portion of the ply 24. The adhesive bond in this area therefore does not interfere with the removal and upward pivoting of the tear-away section. The area of glue application cannot be rigidly defined. It may in some cases be desirable to limit the area to the portion of the flap just discussed. The size of this portion could be increased by extending the side edge 86 of flap 30 all the way up to intersect with the lower horizontal edge 90, eliminating the intermediate tapered edge 88. If it is desired to adhere all portions of the lower edge of the flap 30 to the underlying ply 24 in order to eliminate any loose edges, the glue pattern can be as shown in FIG. 3, which results in adherence of the area of the flap 30 adjacent the lower edge 90 and the small triangular portion of the flap between the edges 88 and the tear-away cuts 50 to the underlying ply 24. Because this glued area is so small relative to the unattached portion of the flap, the bond readily is broken upon the tab 48 being pulled and lifted up. Thus the flap 30 is either not bonded at all to any part of the underlying ply 24 other than the tear-away section or it is bonded to such a small portion of the ply outside the boundaries of the tear-away section that interference to the upward lifting of the tear-away section is either nonexistent or minimal and easily overcome.

Although the lower edge configuration of the center flap 28 is different from the configuration of the end flaps, the principle of operation is the same, with the application of glue following the same guidelines described in connection with the end flaps.

The carrier design permits the use of a tear-away section without compromising the structural integrity of the carrier. By maintaining the ends of the tear-away cut lines 50 outwardly spaced from the ends of the flange support edges 74, the danger of the tear-away section prematurely failing due to an unusually large downward force exerted on a flange support edge is eliminated.

The design also results in provision of a narrow handle panel, which not only permits use of a neck clip carrier to carry three bottles but maintains the size of the carrier blank at a minimum. The fold lines 20 and 78 permit the handle panel to be folded down even with the top of the carrier to permit stacking of carriers during storage and shipping.

Although the invention has been illustrated in connection with a neck clip carrier adapted to support bottles having flanges located at a point below the cap, it will be understood that it may also be used with other bottle designs as well, as long as they have a flange-like projection or shoulder which the support edges of the cutouts can engage. In this connection, the term "flange", as used in the specification and claims, is intended to encompass all types of flanges or flange-like projections engaged by the support edges of the side panel cutouts. In addition, although described in connection with a three-bottle carrier, the principles of the invention will apply equally to carriers adapted to carry fewer or greater numbers of bottles.

It should now be appreciated that the invention provides a means for facilitating removal of bottles one at a time from a two-ply neck clip carrier without compromising the structural integrity of the carrier and without requiring a more expensive production blank.

It should be apparent that the invention is not necessarily limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A neck clip bottle carrier, comprising:

a bottom panel having openings therein for receiving the necks of bottles;

side panels connected to the bottom panel along fold lines, the side panels being angled toward each other and meeting at an apex;

each side panel being comprised of inner and outer plies of material;

the upper portions of both plies of the side panels containing openings for receiving the necks of bottles, the openings in both plies including adjacent lower edges for engaging the underside of outwardly extending flanges on the bottle necks to support the bottles in the carrier;

the inner ply of one of the side panels including a tear-away section beneath each bottle neck opening; and the outer ply of said one side panel being comprised of a plurality of separate individual flaps having side edges and lower edges, each separate flap overlying one of the tear-away sections and extending from a fold line at the apex of the carrier, adjacent side edges of adjacent flaps being spaced from each other.

2. A neck clip bottle carrier as defined in claim 1, wherein each tear-away section includes a tab extending beyond the associated overlying flap to a point below the bottom panel.

3. A neck clip bottle carrier as defined in claim 1, wherein each flap is adhered to a portion of an underlying tear-away section adjacent the bottom panel.

4. A neck clip bottle carrier as defined in claim 3, wherein the side edges of the flaps adjacent the lower edges thereof substantially coincide with weakened lines of underlying tear-away sections.

5. A neck clip bottle carrier as defined in claim 3, wherein the flaps are adhered to the inner ply fop a short distance outside the weakened lines of the tear-away sections.

6. A neck clip bottle carrier as defined in claim 1, wherein each tear-away section is comprised of weakened lines terminating at points outwardly spaced from the lower edges of the bottle neck openings.

7. A neck clip bottle carrier as defined in claim 6, wherein the weakened lines of the tear-away sections terminate at a substantially horizontal fold line which is spaced from and substantially parallel to the apex of the carrier.

8. A neck clip bottle carrier as defined in claim 7, wherein the weakened lines of the tear-away sections terminate at a point higher than the lower edges of the bottle neck openings.

9. A neck clip bottle carrier as defined in claim 1, wherein the carrier has three bottle neck openings and three separate spaced outer ply flaps, the intermediate outer ply flap being connected to a handle panel connected to the outer ply of the other side panel.

10. A blank for forming a neck clip bottle carrier, comprising:

a bottom panel section containing openings for receiving the necks of bottles;

the bottom panel section having an edge connected along a fold line to a first inner side panel section and an opposite edge connected along a fold line to a first outer side panel section;

the first inner side panel section being connected along a fold line to a second inner side panel section;

the first outer side panel section being connected along a fold line to a second outer side panel section;

the first inner side panel section being adhered to the second outer side panel section and the second inner side panel section being adhered to the first outer side panel section in a carrier formed from the blank;

the first and second inner side panel sections containing common bottle neck openings, and the first and second outer side panel sections containing common bottle neck openings;

the first inner side panel section including weakened lines forming a tear-away section adjacent each bottle neck opening; and the second outer ply section being comprised of a plurality of separate individual flaps having side edges and lower edges, each separate flap extending from the fold line connecting the first outer side panel section to the second outer side panel section, adjacent side edges of adjacent flaps being spaced from each other, each flap overlying one of the tear-away sections in a carrier formed from the blank.

11. A blank as defined in claim 10, wherein each tear-away section includes a tab extending into an adjacent bottle neck opening in the bottom panel section.

12. A blank as defined in claim 10, wherein each flap is adhered to a portion of an underlying tear-away section adjacent the bottom panel section in a carrier formed from the blank.

13. A blank as defined in claim 12, wherein the side edges of the flaps adjacent the lower edges thereof substantially coincide with weakened lines of underlying tear-away sections in a carrier formed from the blank.

14. A blank as defined in claim 10, wherein the weakened lines of each tear-away section terminate in the first inner side section at points outwardly spaced from the ends of the edges of the common bottle neck openings therein.

15. A blank as defined in claim 14, wherein the weakened lines of the tear-away sections terminate at a fold line spaced from the fold line connecting the first and second inner side panel sections.

* * * * *